United States Patent [19]

Watanabe et al.

[11] Patent Number: 4,905,538

[45] Date of Patent: Mar. 6, 1990

[54] CAMSHAFT

[75] Inventors: Koji Watanabe; Makoto Kano; Shigeoki Sawada; Ryoji Makino, all of Yokohama, Japan

[73] Assignee: Nissan Motor Co., Ltd., Yokohama, Japan

[21] Appl. No.: 301,077

[22] Filed: Jan. 24, 1989

[30] Foreign Application Priority Data

Jan. 25, 1988 [JP] Japan ..... 63-14174

[51] Int. Cl.[4] ..... F16H 53/00

[52] U.S. Cl. ..... 74/567; 219/121.17; 219/121.38; 219/121.66

[58] Field of Search ..... 219/121.16, 121.17, 219/121.37, 121.38, 121.66, 121.65; 74/567

[56] References Cited

U.S. PATENT DOCUMENTS 4,686,349 8/1987 Kawazu et al. ..... 219/121.61 X

FOREIGN PATENT DOCUMENTS 0161624 11/1985 .
55-148772 11/1980 Japan .
60-184694 9/1985 Japan .
60-234167 11/1985 Japan .
60-234168 11/1985 Japan .
60-234169 11/1985 Japan .
60-258426 12/1985 Japan .
61-522 1/1986 Japan .

*Primary Examiner*—C. L. Albritton
*Attorney, Agent, or Firm*—Foley & Lardner, Schwartz, Jeffery, Schwaab, Mack, Blumenthal & Evans

[57] ABSTRACT

A camshaft of a valve operating system for an internal combustion engine, is formed of iron-based alloy casting and has cam sections, each of which is in slidable contact with a heat resistant tip of a rocker arm. The cam section is formed at its surface portion with a surface hardened layer formed of an air-cooled chilled structure. The surface hardened layer is formed by remelting a part of the surface of the casting after preheating. An intermediate hardened layer of a heat affected zone is formed in contact with the surface hardened layer and has a thickness ranging from 0.5 to 2.0 mm. The intermediate hardened layer is formed of a mixed structure of bainite transformation phase and troostite and is formed by being thermally affected during the remelting.

9 Claims, 2 Drawing Sheets

(x350)

(x100)

CAMSHAFT

BACKGROUND OF THE INVENTION

1. Field of the Invention

This invention relates to improvements in a camshaft of a valve operating system for an internal combustion engine, and more particularly to such a camshaft which undergoes remelting treatment to form a hardened layer at the surface section thereof.

2. Description of the Prior Art

Camshafts of a valve operating system for an internal combustion engine are required to be high in wear resistance particularly at the cam surface which is slidably contactable with an opposite member or a rocker arm. In order to improve the wear resistance, it has been proposed and put into practical use to set a chilling block at a part of a die for casting the camshaft, so that super cooling is made to a part (in contact with the chilling block) of the die thereby forming a chilled hardened layer in the casting. However, according to this method, setting the chilling block is troublesome while increasing production of casting fin or burr thereby requiring removing steps therefor.

As other methods for forming the chilled hardened layer, there have been proposed induction hardening and remelting treatment which is carried out by remelting the surface of the camshaft by high density heat energy such as TIG (tungsten inert gas) arc and thereafter by allowing the camshaft to be self-cooled. A variety of such conventional remelting treatments have been proposed to form the chilled hardened layer in the camshaft as listed below: 1) Remelting treatment by plasma arc is made to the surface of the camshaft whose material is gray cast iron essentially consisting of carbon (C) in an amount ranging from 3.0 to 3.6% by weight, silicon (Si) in an amount ranging from 1.5 to 2.4% by weight, phosphorus (P) in an amount not more than 0.1% by weight, manganese (Mn) in an amount ranging from 0.08 to 0.2% by weight, and balance being iron (Fe) as disclosed in Japanese Patent Provisional Publication No. 60-184694. 2) A chilled hardened layer whose major phase is cementite is formed throughout the whole periphery of the cam surface under remelting treatment and self-cooling as disclosed in Japanese Patent Provisional Publication No. 60-234167). 3) A chilled hardened layer (having a major phase of cementite) and a quench hardened layer are formed throughout the whole periphery of the cam surface as disclosed in Japanese Patent Provisional Publication No. 60-234169. 4) A chilled hardened layer (having a major phase of cementite) occupies 10 to 75% of the whole cam surface, while quench hardening is made to the remaining cam surface, as disclosed in Japanese Patent Provisional Publication No. 60-258426. Other similar techniques have been developed as disclosed in Japanese Patent Provisional Publication Nos. 55-148772, 60-234168, and 61-522.

However, difficulties have been encountered in such conventional techniques to form a chilled hardened layer. In other words, in the conventional techniques, a mixed structure of bainite and troostite cannot be formed immediately below and in contact with the chilled layer for the reasons of no control of cooling rate made after the remelting treatment, no preheating of the camshaft material made prior to the remelting treatment, and the like. It is confirmed that the camshaft is low in pitting resistance during engine running if the layer in contact with the chilled layer is formed of only bainite transformation phase. No control of cooling rate after the remelting treatment also leads to a problem that defects are produced in the chilled structure. No control of preheating also leads to the problem of production of cracks after finish polishing and formation of pearlite structure which causes a low pitting resistance. Additionally, in order to control the cooling rate after the remelting treatment, a special facility therefor is required thereby increasing production cost.

SUMMARY OF THE INVENTION

It is an object of the present invention to provide an improved camshaft formed of iron-based alloy casting, solving the shortcomings encountered in conventional camshafts without requiring complicated facilities and troublesome production processes.

Another object of the present invention is to provide an improved camshaft formed of iron-based alloy casting, excellent in wear resistance and pitting resistance while being low in attacking ability against an opposite member or rocker arm.

The camshaft according to the present invention is formed of iron-based alloy casting and comprised of a cam section. The cam section is formed in at least a part with a first hardened layer of air-cooled chilled structure. The first hardened layer forms at least a part of the surface of the cam section and is formed by remelting the iron-based alloy casting after preheating. The cam section is further formed with a second hardened layer of a heat affected zone, which layer is in contact with the first hardened layer. The second hardened layer has a thickness ranging from 0.5 to 2.0 mm and is formed of a mixed structure of bainite transformation phase and troostite. The heat affected zone is formed by being affected under the remelting.

Accordingly, the camshaft of the present invention is prevented from production of defects in the chilled structure and from production of crack after finish polishing. Additionally, there is no possibility of formation, of pearlite structure which causes a low pitting resistance. As a result, the camshaft is excellent in pitting resistance and low in attacking ability against the opposite member or rocker arm (particularly a wear resistant tip thereof).

DETAILED DESCRIPTION OF THE INVENTION

Figure 1:
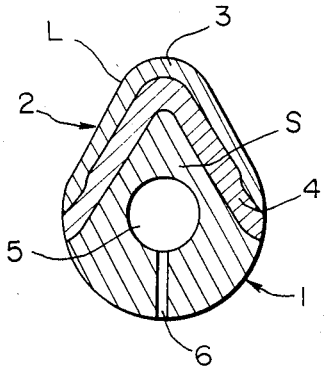
FIG. 1 is a cross-sectional view of an embodiment of a camshaft according to the present invention, taken along a plane perpendicular to the axis of the camshaft.

According to the present invention, a camshaft is formed of iron-based alloy casting (cast iron) and comprised of a cam section; a first hardened layer of air-cooled chilled structure and formed in at least a part of the cam section, the first layer forming at least a part of the surface of the cam section and being formed by remelting the iron based alloy casting after preheating; and a second hardened layer of a heat affected zone and in contact with the first hardened layer, said second hardened layer having a thickness ranging from 0.5 to 2.0 mm and being formed of a mixed structure of bainite transformation phase and troostite, the heat affected zone being formed by being thermally affected under the remelting.

The iron-based alloy casting as the material of the camshaft preferably consists essentially of carbon (C) in an amount ranging from 3.0 to 3.5% by weight, chromium (Cr) in an amount ranging from 0.5 to 1.0% by weight, molybdenum (Mo) in an amount ranging from 0.1 to 0.3% by weight, nickel (Ni) in an amount ranging from 0.1 to 0.3% by weight, manganese (Mn) in an amount ranging from 0.5 to 1.0% by weight, phosphorus (P) in an amount not more than 0.1% by weight, sulfur (S) in an amount not more than 0.1% by weight, silicon (Si) in an amount ranging from 1.5 to 2.5% by weight, and balance being iron (Fe) and impurities.

The above content ranges of respective elements of the iron-based alloy casting are determined by the following rationale: With respect to C, if the content of C is less than 3.0% by weight, there is a tendency to produce an incomplete chilled structure and therefore the resultant casting is lower in wear resistant. If the content of C is more than 3.5% by weight, graphiting phenomena becomes conspicuous. With respect to Cr, if the content of Cr is less than 0.5% by weight, a tendency in which the resulting casting forms white pig iron or chilled structure is suppressed thereby forming a thin chilled structure while lowering quench hardening ability of the casting material of the camshaft. Additionally, the heat affected zone is brought into relation to the pearlite nose in a Time-Temperature-Transformation (T.T.T.) diagram during heating and cooling and therefore the resultant casting develops a pearlite matrix thereby increasing wear amount and causing pitting. If the content of Cr is more than 1.0% by weight, attacking ability of the resultant casting against an opposite member (for example, a wear resistant tip of a rocker arm) becomes high although the wear resistance of the resultant casting is not so improved. Additionally, the chilled structure unavoidably extends to the central part of the resultant casting as the material of the camshaft. This makes difficult the machining of a central oil hole or passage.

With respect to Mo, if the content of Mo is less than 0.1% by weight the resultant casting becomes insufficient in wear resistance while causing pitting for the same reasons as with Cr. If the amount of Mo is more than 0.3% by weight, attacking ability of the resultant casting against the opposite member such as the rocker arm tip becomes high although the wear resistance of the resultant casting is not so improved. Additionally, the chilled structure unavoidably extends to the central part of the resultant casting the material of the camshaft. This makes difficult the machining of a central oil hole or passage. With respect to Ni, if the content of Ni is not within the range from 0.1 to 0.3 by weight, the heat affected zone cannot become a hardened layer formed of a mixed structure of bainite transformation phase and troostite so that the resultant casting is low in its wear resistance and high in attacking ability against the opposite member such as the rocker arm tip. With respect to Mn, if the content of Mn is less than 0.1% by weight, graphiting phenomena becomes conspicuous. If the content of Mn is more than 1.0% by weight, a chilled structure is formed after casting thereby raising the hardness of the whole resultant casting and thus lowering machining ability, though the graphiting phenomena is prevented. With respect to P if the content of P is more than 0.1% by weight, brittle steadite phase ($Fe$-$Fe_3C$-$Fe_3P$) crystallizes out and therefore cracks tend to be produced along the steadite phase so that the resultant casting becomes low in pitting resistance. With respect to S, if the content of S is more than 0.1% by weight, the resultant casting is low in machining ability.

The iron-based alloy casting as the material of the camshaft is preheated prior to the remelting treatment. If the remelting treatment is carried out without preheating and then air-cooling commenced together with self-cooling, the rate of cooling becomes too high and therefore the heat affected zone tends to form a martensite matrix. A camshaft formed of such a casting is not only high in attacking ability against an opposite member such as a rocker arm tip but also tends to give rise to cracks and pitting.

Thus, the camshaft formed of the iron-based alloy casting undergoes preheating treatment prior to the remelting treatment in order to prevent the cooling rate after the remelting treatment from becoming excessively high so that the heat affected zone is formed of the mixed structure of bainite transformation phase and troostite. In this case, the temperature of the preheating is preferably within a range from 200° to 300° C. Because, if the preheating temperature is lower than 200° C., the above-mentioned effect is difficult to obtain. If the temperature is higher than 300° C., the cooling rate is too low and therefore pearlite is formed thereby lowering wear resistance.

The remelting treatment by radiation of high density heat energy is made onto the casting preferably at 200° to 300° C. the above-mentioned preheating. The radiation of density energy is carried out preferably by means of TIG (tungsten inert gas) arc, plasma arc, laser beam, electron beam or the like.

Figure 2:
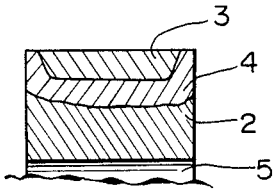
FIG. 2 is a fragmentary cross-sectional view of the camshaft of the FIG. 1, taken along a plane containing the camshaft axis.

FIGS. 1 and 2 illustrate an embodiment of the camshaft 1 according to the present invention. The camshaft 1 has a cam section 2 including a cam lobe portion L which is formed with a surface hardened layer 3 of the chilled structure. The surface hardened layer 3 forms a major part of the surface of the cam lobe portion L. An intermediate hardened layer 4 of the heat affected zone is formed below and outside the opposite ends of the surface hardened layer in the axial direction of the cam section 2, the intermediate hardened layer 4 being in contact with the surface hardened layer 3. The intermediate hardened layer 4 of the heat affected zone is formed of the mixed structure of bainite transformation phase and troostite, and has a thickness ranging from 0.5 to 2.0 mm. A section S around the axis of the cam section 2 is not thermally affected and is therefore formed of the iron-based alloy casting as casted. The section S is formed at its central part with an oil passage 5 and an oil hole 6 through which lubricating oil is supplied to the cam surface to which the opposite member or the rocker arm tip is slidably contactable.

Figure 3:
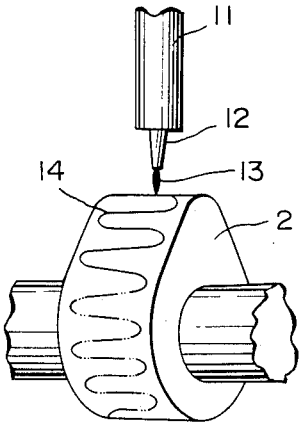
FIG. 3 is a schematic perspective view showing a manner of a remelting treatment to produce the camshaft of FIG. 1.

The camshaft 1 is produced, for example, in the following manner: Molten metal having the above-mentioned composition of the iron-based alloy casting is poured into a die to form the material (casting) of the camshaft. After separation of the camshaft material or casting from the die, the camshaft material is preheated at 200° to 300° C. upon which radiation of high density heat energy is made on the surface of the cam section 2. For example, TIG arc is used for the source of the high density heat energy, in which the arc 13 is generated between the tungsten electrode 12 and the cam section 2 of the camshaft 1 as shown in FIG. 3 thus accomplishing the remelting treatment. During this remelting treatment, the cam section 2 is rotated while adjusting the distance between the surface of the cam section 1 and the tungsten electrode 12, in which the arc 13 moves along a locus 14, a part of which may cross or overlap with each other or approach towards each other. The locus 14 is formed at a part of the periphery of the cam section 2 as indicated by a solid line in FIG. 3, and may be formed throughout the whole periphery of the cam section 2 as indicated by the solid line and a dot-dot dash line in FIG. 3. The surface portions of the cam section 2 remolten under the action of the arc 13 are successively cooled in atmospheric air thereby forming the surface hardened layer 3 of the remolten and chilled structure, in which the intermediate hardened layer 4 of the mixed structure of bainite transformation phase and troostite is formed to have a thickness of 0.5 to 2.0 mm in the heat affected zone (due to the remelting treatment) in contact with the surface hardened layer 3.

EXAMPLE AND COMPARATIVE EXAMPLES

Experiments were conducted to confirm the effect of the present invention, with which Example (Sample No. 1) of the present invention will be discussed hereinafter in comparison with Comparative Examples (Sample Nos. 2 to 16) which are not within the scope of the present invention.

Molten metals of Sample Nos. 1 to 15 were prepared to have respective compositions as shown in Table 1. Each molten metal was casted and naturally cooled without using a chilling block, thereby producing the material of the camshaft. The thus obtained camshaft material as machined to have predetermined dimensions thus obtaining a camshaft material to be subjected to remelting treatment, in which the black surface film of cam sections (2) and journal sections (each located between the cam sections) was removed in addition to machining the formation of a hollow oil passage (5) and a cam oil hole (6).

Each camshaft material was preheated so that its temperature, reached a preheating temperature or was preheated in a furnace. It is to be noted that such preheating was not made to the camshaft materials of Sample Nos. 13 and 14. Then, high density heat energy was radiated onto the preheated camshaft material by means of a torch (11) for TIG arc under conditions shown in Table 2 (showing the radiation conditions of the TIG arc), thus remelting the cam surface (to be slidably contactable with a wear resistant tip of a rocker arm). Thereafter, for the purpose of cooling, the camshaft material subjected to the remelting treatment was kept in a temperature maintaining bath at 150° to 350° C. for a maintaining time as shown in Table 1. It is to be noted that such a cooling treatment was not made to the camshaft materials of Sample Nos. 1, 13 and 14 which were self-cooled or naturally cooled in atmospheric air. As a result, a surface hardened layer or chilled layer (3), and an intermediate hardened layer (4) or heat affected zone layer, were formed in a surface part of the cam section (2) of the camshaft material. Subsequently, the surface of the cam section (2) of the camshaft material was polished to obtain a resultant product or camshaft.

TABLE 1

| Sample No. | Component of camshaft material (Wt %) C | Cr | Mo | Mn | Ni | P | S | Si | Preheating temp. (°C.) | Maintaining time (min.) of cooling | Structure of chilled layer and heat affected zone layer | Wear amount (the maximum wear depth: μm) Cam nose top | Rocker arm tip | Pitting in cam section | Defect in chilled layer |
|---|---|---|---|---|---|---|---|---|---|---|---|---|---|---|---|
| 1 | 3.3 | 0.5 | 0.2 | 0.7 | 0.2 | 0.03 | 0.03 | 2.2 | 250 | 5 (air-cooled) | Bainite, troostite | 5 | 10 | None | Not found |
| 2 | 3.5 | 1.0 | 1.0 | 0.7 | — | 0.05 | 0.05 | 2.2 | 300 | 25 | Bainite | 5 | 12 | " | Found |
| 3 | 3.3 | 0.5 | 0.3 | 0.6 | — | 0.05 | 0.05 | 2.1 | 200 | 11 | " | 8 | 9 | " | Not found |
| 4 | 3.1 | 0.5 | 0.8 | 0.9 | — | 0.04 | 0.06 | 2.3 | 200 | 19 | " | 5 | 15 | " | Found |
| 5 | 3.3 | 0.7 | 0.7 | 0.7 | — | 0.04 | 0.05 | 2.2 | 250 | 18 | " | 4 | 18 | " | " |
| 6 | 3.2 | 0.9 | 0.4 | 0.4 | — | 0.05 | 0.05 | 2.3 | 250 | 13 | " | 10 | 8 | " | " |
| 7 | 3.3 | 0.3 | 0.1 | 0.5 | — | 0.05 | 0.05 | 2.2 | 300 | 18 | Pearlite (thin chilled layer) | 85 | 52 | Occurred | Not found |
| 8 | 3.3 | 0.5 | 0.1 | 0.5 | — | 0.05 | 0.05 | 2.3 | 400 | 13 | Pearlite | 53 | 35 | " | " |
| 9 | 3.3 | 0.3 | 0.1 | 0.7 | — | 0.05 | 0.05 | 2.2 | 250 | 12 | Pearlite (thin chilled layer) | 250 | 225 | " | " |
| 10 | 2.8 | 0.5 | 0.3 | 0.6 | — | 0.05 | 0.05 | 2.2 | 280 | 18 | Pearlite (thin chilled layer) | 47 | 42 | " | " |
| 11 | 3.3 | 0.5 | 0.8 | 0.6 | — | 0.20 | 0.05 | 2.2 | 280 | 17 | Bainite | 12 | 15 | " | Found |
| 12 | 3.3 | 1.2 | 1.2 | 0.8 | — | 0.05 | 0.05 | 2.3 | 300 | 25 | " | 3 | 18 | None | " |
| 13 | 3.3 | 0.5 | 0.3 | 0.6 | — | 0.05 | 0.05 | 2.2 | None | 5 (air-cooled) | Martensite | 8 | 35 | Occurred | Not found |
| 14 | 3.3 | — | — | 0.6 | — | 0.05 | 0.08 | 2.2 | None | 6 (air-cooled) | Pearlite | 40 | 37 | " | " |
| 15 | 3.3 | 0.5 | 0.3 | 0.6 | — | 0.05 | 0.05 | 2.2 | 500 | 45 | " | 35 | 28 | None | " |
| 16 | 3.3 | 0.6 | 0.2 | 0.7 | — | 0.20 | 0.05 | 2.2 | 200–350 | — | " | 175 | 160 | " | " |

TABLE 2

| Item | Condition |
|---|---|
| Shield gas | Argon (Ar) |
| Flow rate of Shield gas | 1.5 l/min. |
| Distance between electrode (12) and surface of cam section (2) | 1.7 mm |
| Value of direct current | 81–108 A |
| Moving speed of electrode (12) | 15 mm/sec. |

For the purpose of a further comparison, molten metal of Sample No. 16 was prepared to have a composition shown in Table 1. The molten metal was poured into a die provided into a chilling block, thereby producing the material of the camshaft. The thus obtained camshaft material was machined to have predetermined dimensions, in which the black surface film of cam sections (2) and journal sections (each located between the cam sections) was removed in addition to machining the formation of a hollow oil passage (5) and a cam oil hole (6). Thus, a resultant product or camshaft of Sample No. 16 was produced.

Figure 4:
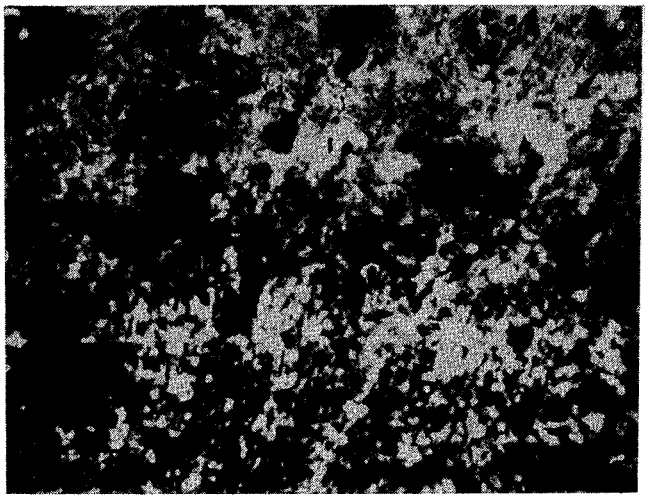
FIG. 4 is a microphotography in 350 magnifications of a metallic structure of a chilled hardened layer in a camshaft of a Comparative Example (not within the scope of the present invention), showing defects in the chilled hardened layer.
Figure 5:
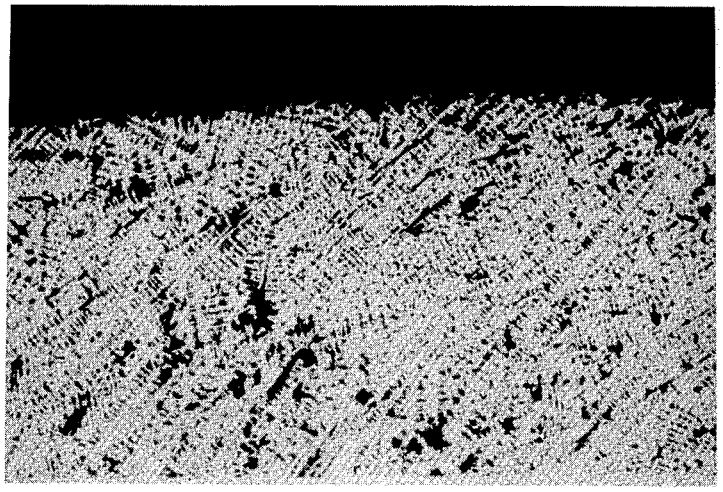
FIG. 5 is a microphotography in 100 magnifications of a metallic structure of a chilled hardened layer and a heat affected zone layer of the camshaft of the Example according to the present invention.

Next, inspection was conducted for the structure of the chilled layer and the heat affected zone layer which is located immediately below and on the opposite sides of the chilled layer, thereby obtaining the results shown in Table 1. Additionally, defects in the chilled layer were inspected to obtain the results also shown in Table 1. In this connection, a metallic structure of the camshaft of Sample No. 2. having the defects in the chilled layer is shown in FIG. 4, while a metallic structure of the camshaft of Sample No. 1 having no defect was shown in FIG. 5.

DURABILITY TESTS

In order to evaluate the camshaft of the present invention, a durability test was conducted on each of the camshafts of Sample Nos. 1 to 16 under test conditions shown in Table 3.

TABLE 3

| Item | Condition | |
|---|---|---|
| Engine type | In-line 4 cylinders (OHC), displacement 1800 cc | |
| Engine driving method | Motoring | |
| Used lubricating oil | ZnDTP not added, 7.5W - 30 | |
| Valve spring | Biasing force: 60% higher than normal | |
| Test method | 600 r.p.m. × 20 hrs.<br>4000 r.p.m. × 20 hrs. | 1 cycle × 5 |

After the durability test, the maximum wear depth in the cam nose top (the tip portion of the cam section of the camshaft) and the rocker arm tip (the heat resistant tip of the rocker arm) in slidable contact with the cam surface of the cam section were measured. Additionally, inspection was made to determine whether there occurred pitting or not in the cam nose section. The results are also shown in Table 1.

As apparent from FIG. 1, the camshaft material of Example of Sample 1 was prepared to have an iron-based alloy casting having the composition including Cr in an amount ranging from 0.5 to 1.0% by weight, Mo in an amount ranging from 0.1 to 0.3% by weight, and Ni in an amount ranging from 0.1 to 0.3% by weight. The camshaft material was preheated at a suitable temperature and thereafter was subjected to the remelting treatment in which the surface section of the cam section was remolten. The camshaft material subjected to the remelting treatment was then air-cooled in atmospheric air, thereby obtaining the camshaft of Sample No. 1. The thus obtained camshaft was formed at its surface section with the chilled layer and the heat affected zone layer which was located immediately below and at the opposite sides of the chilled layer. The heat affected zone layer was formed of a mixed structure of bainite transformation phase and troostite. Therefore, the resultant camshaft exhibited very excellent wear resistance while being low in attacking ability against the opposite member or the rocker arm tip.

Concerning the camshafts of the Comparative Examples of Sample Nos. 2, 4, 5 and 6, the content of Mo was too high and therefore there was a tendency that defects and pitting were produced in the chilled layer.

Concerning the camshaft of the Comparative Example of Sample No. 3, Ni was not contained therein, and the structure of the heat affected zone layer was bainite. Accordingly, although this camshaft exhibited slightly good wear resistance, a temperature maintaining facility was necessary to control the cooling rate in the cooling treatment.

Concerning the camshaft of the Comparative Example No. 7, the content of Cr was as low as 0.3% by weight and therefore a tendency to form white pig iron or chilled structure was suppressed thereby minimizing the thickness of the chilled structure while lowering quench hardening ability of the camshaft material. Additionally, the heat affected zone was brought into relation to the pearlite nose of the Time-Temperature-Transformation ,(T.T.T.) diagram during heating and cooling. As a result, the heat affected zone unavoidably had the matrix of pearlite structure. Thus, since the camshaft had the soft pearlite matrix around and immediately below the chilled hardened layer, it was not only large in wear amount but also tended to cause pitting.

Concerning the camshaft of the Comparative Example of Sample No. 8, pearlite structure was formed because of the high preheating temperature, and therefore the camshaft was insufficient in wear resistance while increasing attacking ability against the opposite member or rocker arm tip.

Concerning the camshaft of the Comparative Example of Sample No. 9, the content of Cr was less and therefore the camshaft was low in wear resistance for the same reasons as in the Comparative Example of Sample No. 7.

Concerning the camshaft of Comparative Example of Sample No. 10, the content of C was as small as 2.8% by weight thereby causing a tendency to produce an incomplete chilled structure, which lead to a slightly inferior wear resistance.

Concerning the camshaft of the Comparative Example of Sample No. 11, the content of P was as much as 0.2% by weight and therefore brittle steadite phase ($Fe$-$Fe_3C$-$Fe_3P$) crystallized out in which cracks were formed along the steadite phase. Accordingly, the camshaft was low in pitting resistance.

Concerning the camshaft of Comparative Example of Sample No. 12, the content of Cr and Mo was too high and therefore the attacking ability against the opposite member or rocker arm tip was high despite a small improvement in wear resistance. Additionally, the chilled structure unavoidably extended into the central part of the camshaft material during casting, thus making difficult the machining formation of the hollow oil passage, the oil hole and the like.

Concerning the camshaft of Comparative Example of Sample No. 13, since the camshaft material was subjected to remelting treatment without preheating and thereafter naturally air-cooled, the cooling rate was high so that a martensite matrix was formed in the heat affected zone. This camshaft was not only slightly high in attacking ability against the opposite rocker arm tip, but also tended to produce cracks and pitting during long time use.

Concerning the camshaft of the Comparative Example of Sample No. 14, there was no addition of Cr, Mo and Ni, and air-cooling was carried out after the remelting treatment. As a result, the pearlite matrix was formed in the heat affected zone and therefore this camshaft was low in wear resistance for the same reasons as in the Comparative Example of Sample No. 7.

Concerning the camshaft of the Comparative Example of Sample 15, the preheating temperature was too high and therefore the cooling rate after the remelting treatment was low so as to form pearlite. As a result, this camshaft was low in wear resistance for the same reasons as in the Comparative Example of Sample No. 7.

Finally concerning the camshaft of Comparative Example of Sample No. 16 (i.e., a conventional camshaft), since grain of the chilled structure was bulky, the chilled structure was brittle. Accordingly, this camshaft was low in scuffing resistance and therefore was large in wear amount.

What is claimed is:

1. A camshaft formed of iron-based alloy casting, comprising:

a cam section;

a first hardened layer of air-cooled chilled structure and formed in at least a part of said cam section, said first layer forming at least a part of surface of the said cam section and being formed by remelting the iron-based alloy casting after preheating; and a second hardened layer of a heat affected zone and in contact with said first hardened layer, said second hardened layer having a thickness ranging from 0.5 to 2.0 mm and being formed of a mixed structure of bainite transformation phase and troostite, said heat affected zone being formed by being thermally affected under said remelting.

2. A camshaft as claimed in claim 1, wherein said chilled structure is formed by radiation of high density heat energy onto the iron-based alloy casting after the preheating and thereafter by cooling the casting in air.

3. A camshaft as claimed in claim 2, wherein said high density heat energy is generated by one selected from the group consisting of TIG arc, plasma arc, laser beam and electron beam.

4. A camshaft as claimed in claim 1, wherein said preheating is carried out at a temperature ranging from 200° to 300° C.

5. A camshaft as claimed in claim 1, wherein said iron-based alloy casting consists essentially of carbon in an amount ranging from 3.0 to 3.5% by weight, chromium in an amount ranging from 0.5 to 1.0% by weight, molybdenum in an amount ranging from 0.1 to 0.3% by weight, nickel in an amount ranging from 0.1 to 0.3% by weight, manganese in an amount ranging from 0.5 to 1.0% by weight, phosphorus in an amount not more than 0.1% by weight, sulfur in an amount not more than 0.1% by weight, silicon in an amount ranging from 1.5 to 2.5% by weight, with the balance being iron and impurities.

6. A method of producing a camshaft having a cam section and formed of iron-based alloy casting, said method comprising the following steps in the sequence set forth:

preheating the iron-based alloy casting;

radiating high density heat energy onto the casting to remelt at least a part of surface of the cam section so as to form a remelting part, in which a heat affected zone is formed in contact with said remelting part, said heat affected zone having a thickness ranging from 0.5 to 2.0 mm and formed of a mixed structure of bainite transformation phase and troostite; and cooling said remelting section in air so as to form an air-cooled chilled structure in said remelting part.

7. A method as claimed in claim 6, wherein said preheating is carried out at a temperature ranging from 200° to 300° C.

8. A method as claimed in claim 6, wherein said radiating high density heat energy is carried out onto the casting at a temperature ranging from 200° to 300° C.

9. A method as claimed in claim 6, wherein said high density heat energy is generated by one selected from the group consisting of TIG arc, plasma arc, laser beam, and electron beam.

* * * * *